US006263949B1

(12) United States Patent
Guthrie, Jr.

(10) Patent No.: US 6,263,949 B1
(45) Date of Patent: Jul. 24, 2001

(54) HURRICANE RESISTANT SCREEN SYSTEM

(75) Inventor: William J. Guthrie, Jr., Canfield, OH (US)

(73) Assignee: William J. Guthrie Jr., Wellington, FL (US)

( * ) Notice: Subject to any disclaimer, the term of this patent is extended or adjusted under 35 U.S.C. 154(b) by 0 days.

(21) Appl. No.: 09/415,633

(22) Filed: Oct. 12, 1999

(51) Int. Cl.[7] ..... A47G 5/00
(52) U.S. Cl. ..... 160/380; 160/371; 160/378
(58) Field of Search ..... 160/371, 378, 160/380; 209/403; 52/222, 506.05

(56) References Cited

U.S. PATENT DOCUMENTS

| | | | | |
|---|---|---|---|---|
| 1,350,027 | | 8/1920 | Lane . | |
| 2,847,065 | * | 8/1958 | Tolman et al. | 160/378 |
| 3,483,912 | * | 12/1969 | Andrews | 160/380 |
| 3,552,476 | | 1/1971 | Le Tarte | 160/371 |
| 3,696,857 | | 10/1972 | Le Tarte | 160/371 |
| 3,788,216 | | 1/1974 | Lambert | 101/127.1 |
| 4,084,360 | | 4/1978 | Reckson | 52/63 |
| 4,148,724 | * | 4/1979 | Hannon . | |
| 4,662,038 | | 5/1987 | Walker | 24/460 |
| 4,932,457 | | 6/1990 | Duncan | 160/380 |
| 5,020,254 | * | 6/1991 | Sheppard | 160/378 |
| 5,046,546 | | 9/1991 | Benedyk et al. | 160/371 |
| 5,301,737 | | 4/1994 | Martin | 160/380 |
| 5,332,101 | * | 7/1994 | Bakula | 160/378 |

* cited by examiner

*Primary Examiner*—Blair M. Johnson
(74) *Attorney, Agent, or Firm*—Rader, Fishman & Grauer PLLC

(57) ABSTRACT

A screen system for covering openings such as windows and doors includes a frame having a screen mounting portion for receiving an edge of a screen and a retainer bar. The screen is sandwiched between the frame and the retainer bar and the assembly is of heavy-duty constriction to resist high impact forces caused by hurricane force winds and accompanying flying debris. The retainer bar and frame can include one or more barbs to assist in capturing the screen and resisting forces. The retainer bar is also designed to pivot during assembly to tightly draw the screen across the opening in the frame.

21 Claims, 2 Drawing Sheets

HURRICANE RESISTANT SCREEN SYSTEM

FIELD OF THE INVENTION

The present invention relates to a screen attachment system for covering openings such as windows and doors. More particularly, the present invention relates to a heavy duty screen assembly that is resistant to hurricane force winds and associated flying debris, burglars and vandals.

BACKGROUND OF THE INVENTION

Devices for protecting windows from inclement weather, such as hurricanes and tornadoes, are known. One conventional product utilizes a perforated steel panel that is stored in an open position away from the window area and is only moved to a protective position when needed to protect the window. Thus, a user needs to reposition each perforated steel panel to a protective position over each window when a storm threatens. There are a number of drawbacks to the prior art window protection device including the impracticality of using such a device on high rise buildings and other multiple story buildings. In addition, since the perforated steel panel is stored away from the window area, it is unable to otherwise protect the window during normal weather conditions. Further, if a user is away when a storm develops or a storm develops quickly, then the prior known window protection device is out of position to protect the windows. Further, the perforated steel panel of the prior art is not esthetically pleasing and is susceptible to corrosion.

Other various devices for securing a screen to a frame for covering a window or door opening have been developed. However, none of the prior art screens for windows and doors have been developed for protecting against hurricane force winds and associated flying debris. As a result, the prior known screen systems are not strong enough to withstand the forces associated with such severe weather conditions.

SUMMARY OF THE INVENTION

The present invention relates to a screen assembly for resisting hurricane force winds and associated flying debris having a frame that defines an opening and includes an exterior face and an interior face. A screen mounting portion is provided on the frame and includes a base and at least one side wall. At least one retainer bar is provided for cooperating alignment with said screen mounting portion. A screen for covering the opening is positioned on a screen mounting portion and is sandwiched between the frame and the retainer bar. In addition, a plurality of fasteners are positioned relative to the retainer bar such that the retainer bar pivots relative to the screen mounting portion as the fasteners are tightened so as to draw the screen tightly across the opening.

In addition, the present invention contemplates using a high tensile stainless steel mesh screen having wire for resisting high forces associated with severe weather conditions. For example, the wire can have a diameter of at least approximately 0.020 inch. Preferably, the wire is approximately 0.028 to 0.047 inch diameter for resisting high impact forces. In addition, the retainer bar of the present invention includes a cross member that is positioned at an oblique angle relative to the base of the screen mounting portion. The retainer bar can further include one or more barbs for securely capturing and holding the screen both during and after assembly. In addition, one or more frame barbs can be provided in the screen mounting portion of the frame to further assist in securely holding the screen in place.

The retainer bar preferably has a generally H-shaped cross-section including the cross member connected between first and second laterally spaced apart arms and legs. In addition, the first and second legs are offset longitudinally such that one leg extends further than the other leg and assists in creating a pivot motion for the retainer bar. A fastener cover is also contemplated to be mounted to the retainer bar for improved aesthetics.

Accordingly, the present invention provides a heavy-duty screen that can resist hurricane force winds and associated flying debris. For example, the screen of the present invention can resist the force of a two-by-four stud of lumber propelled at the screen at a force comparable to that which would be encountered under hurricane wind conditions. The screen of the present invention is designed to always be in position to cover and protect a window or door and eliminates the need for timely user intervention as discussed in the background section above.

Still further, the present invention provides improved aesthetics for year round use and utilizes stainless steel to prevent corrosion that is typically encountered in coastal locations near an ocean where hurricanes commonly prevail. The screen system also protects against insects and vandals.

BRIEF DESCRIPTION OF THE DRAWINGS

The features and inventive aspects of the present invention will become more apparent upon reading the following detailed description, claims, and drawings, of which the following is a brief description:

DETAILED DESCRIPTION OF PREFERRED EMBODIMENTS

Figure 1:
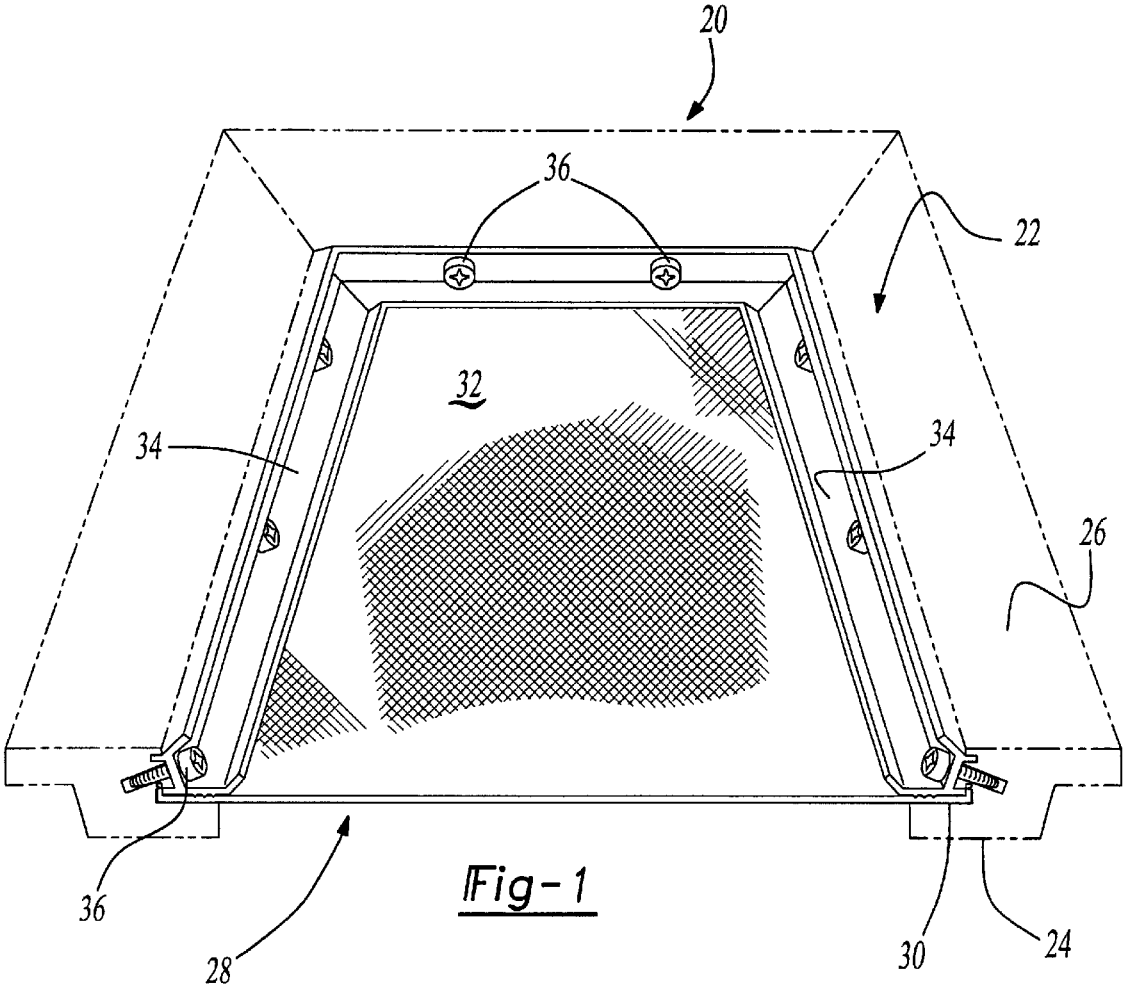
FIG. 1 is a partial perspective view of a hurricane resistant screen system according to the present invention.

FIG. 1 shows a hurricane resistant screen assembly 20 that is designed to resist hurricane force winds and flying debris that accompanies strong winds. A frame 22 has an exterior face 24 and an interior face 26 and further includes a central opening 28. Frame 22 is designed to be of heavy duty construction. Preferably, frame 22 is fabricated from aluminum using an extrusion process. However, any suitable material or manufacturing technique can be used.

In addition, frame 22 has a recessed screen mounting portion 30 for receiving a screen 32 that is sandwiched between screen mounting portion 30 of frame 22 and a retainer bar 34. Retainer bar 34 is affixed to frame 22 using a plurality of spaced apart fasteners 36. Screen 32 can take any suitable form including being a perforated plate or a wire mesh. Preferably, screen 32 is a wire mesh and is fabricated from high tensile stainless steel wire. The mesh can be fabricated from any suitable diameter wire. For example, the wire can have a diameter greater than or equal to approximately 0.020 inch. Preferably, the wire has a diameter of approximately 0.028 to 0.047 inch for resisting high impact forces. One type of stainless steel wire that is contemplated to be used is 304 stainless steel.

Frame 22 can be designed for attachment to multiple different types of windows and/or doors including, for example, double hung windows, sliding patio screen doors and/or storm doors.

Figure 2:
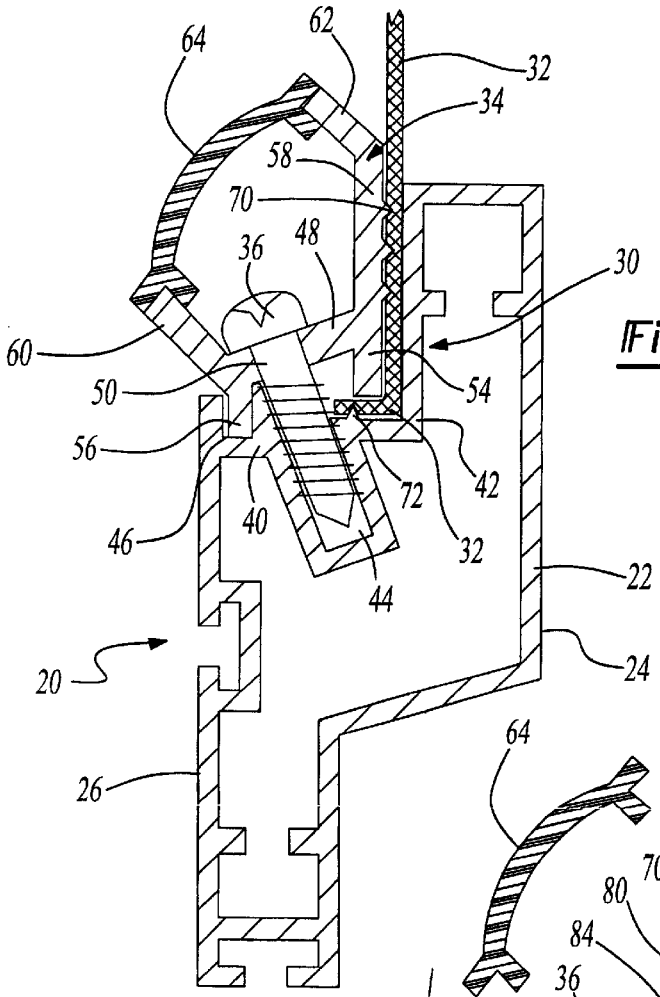
FIG. 2 is a partial cross-sectional view of the hurricane resistant screen system according to the present invention.

FIG. 2 shows a partial cross-sectional view of hurricane resistant screen system 20 with recessed screen mounting portion 30 having a pocket or corner 32 located between a base 40 and a side wall 42. In the illustrated embodiment, recessed screen mounting portion 30 has a generally L-shaped cross-section. However, any suitable cross-sectional shape can be used. A first longitudinally extending groove 44 is provided along base 40 of screen mounting portion 30 to receive fasteners 36. Alternatively, groove 44 can be one or more apertures.

Still further, a second groove 46 is optionally, but preferably, provided in base 40 of screen mounting portion 30 and is located a predetermined distance away from corner 38. In the illustrated embodiment, second groove 46 is located adjacent interior face 26 of frame 22. Grooves 44, 46 extend around opening 28 and can be either continuous or intermittent.

Retainer bar 34 includes a cross-member 48 having a plurality of spaced apart apertures 50 for receiving fasteners 36. Apertures 50 are located for alignment with the first groove 44 in base 40 of screen mounting portion 30. In addition, retainer bar 34 includes laterally spaced apart first and second legs 54, 56 that project generally downwardly from cross-member 48. Optionally, but preferably, laterally spaced apart first and second arms 58, 60 project generally upwardly from cross-member 48 to form a generally H-shaped cross-section. In the illustrated embodiment, first leg 54 and first arm 58 are generally vertically aligned. A bent end portion 62 is provided at a distal end of first arm 58. Second arm 60 angles outwardly relative to second leg 56 and is generally parallel to bent end portion 62. Second arm 60 and bent end portion 62 define a channel for receiving a fastener cover 64.

Optionally, but preferably, second leg 56 extends longitudinally downwardly further than first leg 54 to assist in creating a generally clockwise pivoting motion in FIG. 2 as retainer bar 34 is fastened to screen mounting portion 30. The pivoting action of retainer bar 34 helps draw screen 32 tightly across opening 28 removing any slack in the screen. In addition, cross member 48 is designed to be at an oblique angle relative to base 40 of screen mounting portion 30. Fastener 36 is positioned generally perpendicular to cross member 48 such that fastener 36 is positioned at an oblique angle relative to base 40. Moreover, fastener 36 is preferably located closer to second leg 56 than first leg 54 to better control pivoting action and allow for sufficient space for screen 32 to be positioned near corner 38. Another feature that permits smooth pivot action of retainer bar 34 is the predetermined sizing of cross member apertures 50 to allow sufficient play between retainer bar 34 and fastener 36 and thereby accommodate pivoting movement of the retainer bar as fastener 36 is tightened.

An additional optional, but preferable, feature includes one or more barbs 70 being provided on retainer bar 34 to further assist in tightly securing screen 32. Barbs 70 have generally triangular cross-sections, however, any suitably shaped barbed element can be used. As illustrated in FIG. 2, a series of three spaced apart barbs 70 are provided on first arm 58 of retainer bar 34. Further, it is contemplated to provide a frame barb 72 on recessed screen mounting portion 30 for further improving screen retention. For example, frame barb 72 can be provided on base 40 between aperture 44 and corner 38 such that second leg 56 of retainer bar 34 is located between frame barb 72 and corner 38. Thus, a four point screen locking system is provided by barbs 70 and 72 in the illustrated embodiment.

During assembly, screen 32 is placed in recess mounting portion 30 and retainer bar 34 is then positioned with first downwardly projecting leg 54 located in groove 46 and second leg 56 and second arm 60 are positioned near corner 38 for capturing screen 32. Retainer bar 34 is designed to pivot off of first leg 54 in groove 46 when fasteners 36 are tightened. As retainer bar 34 pivots in a generally clockwise direction, barbs 70 grab corresponding portions of the heavy duty screen 32 and pull the screen tightly over opening 28. Since screen 32 is of very high tensile strength, screen 32 does not tear, rip or otherwise become damaged during the tightening assembly process. In addition, first leg 54 is pivoted downwardly toward base 40 to tightly press and hold that portion of screen 32 that is captured between first leg 54 and base 40. Frame barb 72 also cooperates with first leg 54 to securely hold screen 32 in position during high force winds.

Figure 3:
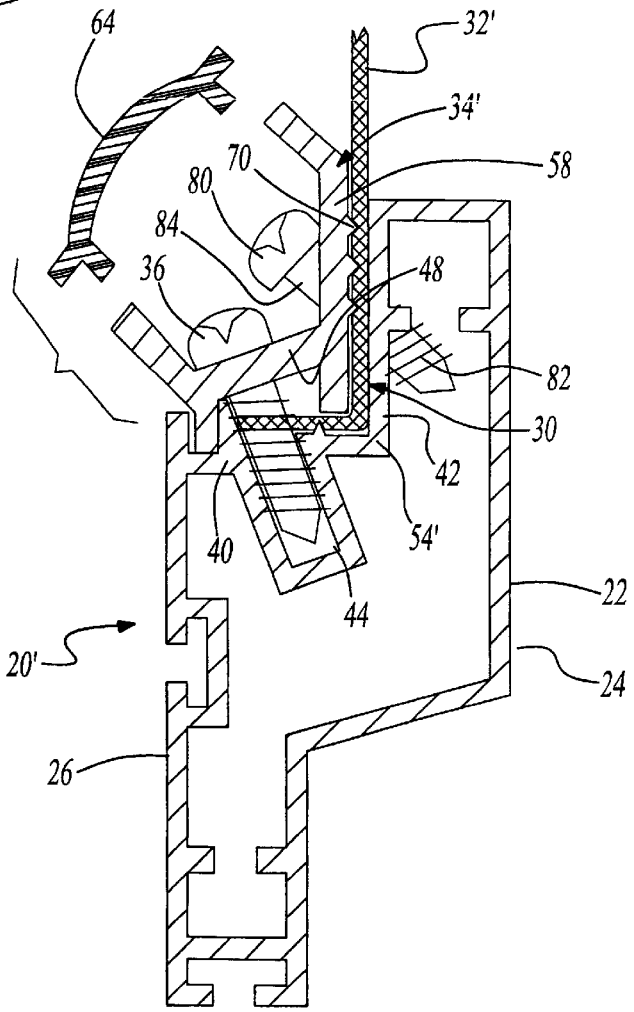
FIG. 3 is a partial cross-sectional side view of a hurricane resistant screen system according to another embodiment of the present invention.

A second embodiment of the present invention is illustrated in FIG. 3. The embodiment of FIG. 3 has many of the same features and elements shown in the embodiment of FIG. 2 and like numerals have been used to refer to the similar elements. A hurricane resistant screen assembly 20' shown in FIG. 3 has an additional set of fasteners 80 to further retain screen 32' and add overall rigidity to the assembly 20'. Fasteners 80 are designed to pass through screen 32' for improved screen retention. To accommodate fasteners 80, a set of apertures 82 are provided in side wall 42 of recessed screen mounting portion 30 to securely connect frame 22 to a retainer bar 34'. In the alternative, the set of apertures 82 could be a groove, similar to first groove 44.

In addition, another series of spaced apart apertures 84 are provided in first arm 58 of retainer bar 34 for aligning with a corresponding aperture from the set of apertures 82 in screen mounting portion 30. Thus, hurricane resistant screen assembly 20' utilizes two sets of fasteners, the first set of fasteners 36 securing retainer bar 34' tightly against base 40 while the second set of fasteners 80 securely tighten and hold retainer bar 34' against side wall 42 of screen mounting portion 30. Moreover, as shown in FIG. 3, screen 32' can extend further along base 40 such that fasteners 36 pierce screen 32' to further secure screen 32'. The design of the second embodiment provides additional clamping force against screen 32' for enhanced resistance to protect windows and doors against hurricane force winds.

To further provide increased clamping load at first arm 58 and barbs 70, first leg 54' can be designed to be slightly shorter in length, as shown in FIG. 3, such that first arm 58 and barbs 70 will always clamp screen 32' against side wall 42 without interference from first leg 54' contacting screen 32' and clamping it against base 40. In this manner, a high clamp load is consistently provided between first arm 58 and side wall 42 as fasteners 36, 80 are tightened and retainer bar 34' pivots.

Preferred embodiments of the present invention have been disclosed. A person of ordinary skill in the art would realize, however, that certain modifications would come within the teachings of this invention. Features from any of the disclosed embodiments may be selectively utilized in conjunction with any other embodiments. Therefore, the following claims should be studied to determine the true scope and content of the invention.

What is claimed is:

1. A screen assembly for resisting hurricane force winds comprising:

a frame defining an opening and having an exterior face and an interior face;

a screen mounting portion provided on said frame including a base and at least one side wall;

at least one retainer bar for cooperating alignment with said screen mounting portion, wherein said at least one retainer bar includes a generally H-shaped cross-section;

a screen for covering said opening positioned on said screen mounting portion and sandwiched between said frame and said at least one retainer bar; and a first plurality of fasteners, wherein said fasteners are positioned relative to said retainer bar such that said retainer bar pivots relative to said screen mounting portion as said fasteners are tightened for drawing said screen tightly across said opening.

2. The screen assembly of claim 1, wherein said screen is a high tensile stainless steel mesh having wire of at least approximately 0.020 inch diameter for resisting hurricane force winds and flying debris.

3. The screen assembly of claim 1, wherein said retainer bar includes a cross member positioned at an oblique angle relative to said base of said screen mounting portion.

4. The screen assembly of claim 1, wherein said retainer bar includes a cross member connected to laterally spaced apart first and second legs and first and second arms.

5. The screen assembly of claim 4, wherein said cross member includes a plurality of apertures for receiving said fasteners.

6. The screen assembly of claim 4, wherein said first leg contacts said screen for securely clamping said screen against said screen mounting portion.

7. The screen assembly of claim 4, wherein said first leg is spaced away from said base of said screen mounting portion for ensuring a high clamping load at said first arm of said retainer bar.

8. The screen assembly of claim 1, wherein said screen mounting portion includes a groove for receiving a portion of said retainer bar.

9. The screen assembly of claim 1, further including at least one barb located on said retainer bar for retaining said screen.

10. The screen assembly of claim 1, further including at least one frame barb located on said screen mounting portion for retaining said screen.

11. The screen assembly of claim 1, wherein said screen mounting portion is generally L-shaped.

12. The screen assembly of claim 1, further including a fastener cover for hiding said plurality of fasteners and improving aesthetics.

13. The screen assembly of claim 1, wherein said first plurality of fasteners are positioned in a cross member of the retainer bar and further including a second plurality of fasteners positioned in an arm of the retainer bar.

14. A screen assembly for resisting hurricane force winds comprising:

a frame defining an opening and having an exterior face and an interior face;

a screen mounting portion provided on said frame including a base and at least one side wall;

at least one retainer bar having at least one aperture;

a stainless steel screen mesh including wire having a diameter of at least approximately 0.020 inch for covering said opening and resisting hurricane force winds and flying debris, said screen positioned on said screen mounting portion and sandwiched between said frame and said at least one retainer bar, wherein said retainer bar has a cross-section which includes a cross member having an angularly extending arm and leg connected to each of two pads thereof; and a first plurality of fasteners for insertion into said at least one aperture in said retainer bar for securely attaching said retainer bar to said frame.

15. The screen assembly of claim 14, wherein said fasteners are positioned relative to said retainer bar such that said retainer bar pivots relative to said screen mounting portion as said fasteners are tightened for drawing said screen tightly across said opening.

16. The screen assembly of claim 14, wherein said cross member is positioned at an oblique angle relative to said base of said screen mounting portion.

17. The screen assembly of claim 14, wherein said screen mounting portion includes a groove for receiving a portion of said retainer bar.

18. The screen assembly of claim 14, further including at least one barb provided on one of said retainer bar or said screen mounting portion for improved retention of said screen.

19. The screen assembly of claim 14, wherein said first plurality of fasteners are positioned in said cross member of the retainer bar and further including a second plurality of fasteners positioned in one of said arms of the retainer bar.

20. The screen assembly of claim 14, wherein the screen mesh wire has a diameter of approximately 0.028 to 0.047 inch.

21. A screen assembly for resisting hurricane force winds comprising:

a frame defining an opening and having an exterior face and an interior face;

a screen mounting portion provided on said frame including a base and at least one side wall;

at least one retainer bar having a crosssection which includes a cross member having an angularly extending arm and leg connected to each of two spaced ends thereof;

a high tensile, stainless steel screen having wire of at least approximately 0.028 inch diameter for covering said opening positioned on said screen mounting portion and sandwiched between said screen mounting portion and said at least one retainer bar for resisting hurricane force winds and flying debris;

a first plurality of fasteners located in said cross member of said retainer bar wherein said fasteners are positioned relative to said retainer bar such that said retainer bar pivots relative to said screen mounting portion as said fasteners are tightened for drawing said screen tightly across said opening; and at least one barb provided on said retainer bar for improved gripping of said stainless steel screen.

* * * * *